US006890871B2

(12) United States Patent
Böttger et al.

(10) Patent No.: US 6,890,871 B2
(45) Date of Patent: May 10, 2005

(54) PENETRATION-RESISTANT MATERIAL

(75) Inventors: Christian Böttger, Remscheid (DE); Achim Fels, Wuppertal (DE)

(73) Assignee: Teijin Twaron GmbH, Wuppertal (DE)

( * ) Notice: Subject to any disclaimer, the term of this patent is extended or adjusted under 35 U.S.C. 154(b) by 0 days.

(21) Appl. No.: 10/250,768

(22) PCT Filed: Mar. 8, 2002

(86) PCT No.: PCT/EP02/02549

§ 371 (c)(1),
(2), (4) Date: Jul. 22, 2003

(87) PCT Pub. No.: WO02/075237

PCT Pub. Date: Sep. 26, 2002

(65) Prior Publication Data

US 2004/0096708 A1 May 20, 2004

(30) Foreign Application Priority Data

Mar. 15, 2001 (EP) ..... 01200979

(51) Int. Cl.[7] ..... B32B 27/12

(52) U.S. Cl. ..... 442/135; 442/134; 442/149; 442/239; 442/243; 442/255; 442/263; 428/911

(58) Field of Search ..... 428/911; 442/134, 442/135, 149, 239, 243, 255, 263; 2/2.5

(56) References Cited

FOREIGN PATENT DOCUMENTS

| | | |
|---|---|---|
| EP | 0 310 199 | 4/1989 |
| WO | WO 89/06190 | 7/1989 |
| WO | WO 91/00181 | 1/1991 |
| WO | WO 00/42246 | 7/2000 |

*Primary Examiner*—Ula Ruddock
(74) *Attorney, Agent, or Firm*—Oliff & Berridge, PLC

(57) ABSTRACT

A penetration-resistant material is disclosed comprising at least one layer having a thickness D, the layer comprising a first and second layer of woven fabric, with the first and second layers being bonded together with an adhesive material, the first layer of fabric composed of a first set of threads comprising 3.5 to 20 threads/cm, having a linear density of at least 210 dtex, the filaments forming the threads having a diameter $F_1$, and comprising at least 65% of the fabric weight, and a second set of threads comprising 0.5 to 16 threads/cm and having a linear density of at least 50 dtex, with the second set of threads being at an angle of >0° to 90° with respect to the first set of threads, and the ratio of the number of threads/cm of the first set to that of the second set being >1, and the second layer of fabric being composed of a first set of threads comprising 0.5 to 16 threads/cm and having a linear density of at least 50 dtex, and a second set of threads comprising 3.5 to 20 threads/cm, having a linear density of at least 210 dtex, and comprising at least 65% of the fabric weight, the filaments forming the threads having a diameter $F_2$, with the second set of threads being at an angle of >0° to 90° with respect to the first set of threads, and the ratio of the number of threads/cm of the second set to that of the first set being >1, and the first and second sets of threads of the first fabric layer being oriented parallel to the first and second sets of threads, respectively, of the second fabric layer and the ratio $D/F_1$ and $D/F_2$ being 14.5 to 40.

15 Claims, No Drawings

PENETRATION-RESISTANT MATERIAL

DESCRIPTION

The present invention relates to a penetration-resistant material.

In EP-A 01 200 979, a penetration-resistant material is disclosed comprising at least a double layer of woven fabric, characterized in that the double layer comprises first and second layers of fabric, the first layer of fabric composed of a first set of threads comprising 3.5 to 20 threads/cm, having a linear density of at least 210 dtex, and comprising at least 65% of the fabric weight, and a second set of threads comprising 0.5 to 16 threads/cm and having a linear density of at least 50 dtex, with the second set of threads being transverse to the first set of threads, and the ratio of the number of threads/cm of the first set to that of the second set is >1, and the second layer of fabric composed of a first set of threads comprising 0.5 to 16 threads/cm and having a linear density of at least 50 dtex, and a second set of threads comprising 3.5 to 20 threads/cm, having a linear density of at least 210 dtex, and comprising at least 65% of the fabric weight, with the second set of threads being transverse to the first set of threads, and the ratio of the number of threads/cm of the second set to that of the first set being >1, and wherein the first and second sets of threads of the first fabric layer being oriented parallel to the first and second sets of threads, respectively, of the second fabric layer.

An impact-resistant composite material, i.e., a penetration-resistant material, is described In EP-B 0 397 696. The material is comprised of one or more layers, with at least one of said layers comprising a filament network in a matrix, and the filaments having an equivalent filament diameter, i.e., the diameter of a circle having the same cross-sectional area as the average cross-sectional area of the filaments of the layer. The filaments form a thread which can be fashioned into a woven fabric. EP-B 0 397 696 teaches that the ratio of the layer thickness D to the equivalent filament diameter F is critical for the penetration-resistant effect. According to this teaching, the best penetration-resistant effect, expressed as the $V_{50}$ value, results when said ratio is close to 1. According to EP-B 0 397 696, the penetration-resistant effect of the materials decreases as this ratio increases. With a ratio D/F of 12.8, the penetration-resistant effect decreases to such an extent that EP-B 0 397 696 advises against higher values for the ratio.

Considering the need for additional materials having good penetration-resistant properties, it is the object of the present invention to provide a further penetration-resistant material.

This object is satisfied by a penetration-resistant material comprising at least one layer having a thickness D, the layer comprising a first and second layer of woven fabric, with the first and second layers being bonded together with an adhesive material, the first layer of fabric composed of a first set of threads comprising 3.5 to 20 threads/cm, having a linear density of at least 210 dtex, the filaments forming the threads having a diameter $F_1$, and comprising at least 65% of the fabric weight, and a second set of threads comprising 0.5 to 16 threads/cm and having a linear density of at least 50 dtex, with the second set of threads being at an angle of >0° to 90° with respect to the first set of threads, and the ratio of the number of threads/cm of the first set to that of the second set being >1, and the second layer of fabric being composed of a first set of threads comprising 0.5 to 16 threads/cm and having a linear density of at least 50 dtex, and a second set of threads comprising 3.5 to 20 threads/cm, having a linear density of at least 210 dtex, and comprising at least 65% of the fabric weight, the filaments forming the threads having a diameter $F_2$, with the second set of threads being at an angle of >0° to 90° with respect to the first set of threads, and the ratio of the number of threads/cm of the second set to that of the first set being >1, and the first and second sets of threads of the first fabric layer being oriented parallel to the first and second sets of threads, respectively, of the second fabric layer and the ratio $D/F_1$ and $D/F_2$ being 14.5 to 40.

The term "filament diameter" means the average diameter of the filaments over their length. In case the filaments do not have circular cross-sections, $F_1$ and $F_2$ each mean the diameter of a circle having the same cross-sectional area as the average cross-sectional area of the filaments along their length.

According to the teaching of EP-B 0 397 696, the penetration-resistant effect of the material becomes unattractively poor at a ratio D/F of >12.8. In view of the teaching of EP-B 0 397 696, one skilled in the art and presented with the previously noted object would expect the $V_{50}$ values, already poor at slightly above D/F=12.8, to become even worse with further increase of the D/F ratio. In no case would one skilled in the art thus expect attractive $V_{50}$ values whatsoever resulting from D/F ratios significantly above 12.8. And increase of the $V_{50}$ values with an increasing D/F ratio in the range significantly above 12.8 would be completely inconceivable by one skilled in the art. Exactly this behavior, however, was found with the penetration-resistant material of the invention, as can be seen in the examples of the present invention.

The thickness of the layer is measured according to DIN EN ISO 5084 at a load of 0.1 $N/cm^2$.

In a preferred embodiment of the penetration-resistant material of the invention, $D/F_1$ and $D/F_2$ are 16 to 36.

In further preferred embodiments of the penetration-resistant material of the invention, $D/F_1=D/F_2$.

In further preferred embodiments of the penetration-resistant material of the invention, the ratio of the linear density of the first set of threads to the linear density of the second set of threads of the first layer of fabric, and of the linear density of the second set of threads to the linear density of the first set of threads of the second layer of fabric, is >1, more preferably >4.2, and most preferably >5.9.

Moreover, in a preferred embodiment of the penetration-resistant material of the invention, the number of threads in at least one of the second sets of threads of the first layer of fabric and first sets of threads of the second layer of fabric comprises 0.5 to 8 threads/cm.

A polymer selected from the group comprising thermoplastic, elastomeric, and thermoset materials, or a mixture of polymers selected from at least two of these groups, serves as the adhesive material in the penetration-resistant material of the invention. Especially preferred as thermoplastic materials are polyolefins such as polyethylene, for example LDPE, polypropylene, polyamide, polyester, or mixtures of these polymers or thermoplastic elastomers; as elastomers rubber, silicone, and the like; and as thermoset materials epoxy resins, polyester resins, phenolic resins, and vinyl ester resins. For the penetration-resistant material of the invention, however, two or more of the aforementioned polymers, as well as mixtures thereof, can also serve as the adhesive material.

The adhesive material can consist of the same polymer or polymer mixture in all layers of the penetration-resistant material of the invention. It is also possible that the adhesive material in different layers of the penetration-resistant material of the invention consists of different polymers or polymer mixtures of the aforementioned type.

In further preferred embodiments of-the penetration-resistant material of the invention, the first set of threads of the first layer of fabric and the second set of threads of the second layer of fabric consist of high-strength and preferably high-modulus yarns, selected from one of the groups of aramids, polyethylenes or poly-p-phenylenebenzobisoxazoles, with the p-aramids, particularly poly-paraphenylene terephthalamide, being most preferred in the group of aramids.

In principle, the second set of threads of the first layer of fabric and the first set of threads of the second layer of fabric can be made from any thread material usually having a lower strength than the first set of threads of the first layer of fabric and the second set of threads of the second layer of fabric, such as cotton, viscose, flax, hemp, polyacrylic, or the like. The second set of threads of the first layer of fabric and the first set of threads of the second layer of fabric are preferably made of yarns selected from one of the groups of polyester, polyethylene, polypropylene, or aramid. Preferably, these yarns have high strength and a high modulus.

In further preferred embodiments of the penetration-resistant material of the invention, the first set of threads of the first layer of fabric and the second set of threads of the second layer of fabric consist of aramid threads, and the second set of threads of the first layer of fabric and the first set of threads of the second layer of fabric consist of polyester threads.

In further preferred embodiments of the penetration-resistant material of the invention, the first set of threads of the first layer of fabric and the second set of threads of the second layer of fabric have a linear density of 210 to 6720 dtex, preferably 420 to 3360 dtex, more preferably 420 to 1680 dtex, and most preferably 550 to 1100 dtex. A linear density of 840 dtex was found to be ideal for this application.

In further preferred embodiments of the penetration-resistant material of the invention, the second set of threads of the first layer of fabric and the first set of threads of the second layer of fabric have a linear density of 50 to 280 dtex, particularly preferably 80 to 210 dtex. A linear density of 140 dtex for the second set of threads of the first layer of fabric and the first set of threads of the second layer of fabric was found to be advantageous.

In further preferred embodiments of the penetration-resistant material of the invention, the first set of threads of the first layer of fabric and the first set of threads of the second layer of fabric are warp threads, and the second set of threads of the first layer of fabric and the second set of threads of the second layer of fabric are weft threads.

In a preferred embodiment, at least one of the outer sides of the penetration-resistant material of the invention is provided with a protective layer, which can consist, for example, of a thermoplastic, thermoset, or elastomeric material, or a mixture of these polymers. The protective layer is applied to protect the outer side(s) of the material from damage by excessive abrasion and to improve the ballistic action.

As mentioned above, the penetration-resistant material of the invention comprises at least one layer of the cited type. One skilled in the art can easily determine the number of layers required for a particular ballistic-protective action, for instance by bombardment tests and determination of the $V_{50}$ value of the material.

The penetration-resistant material of the invention can be manufactured, for example, by initially selecting one of the aforementioned first and second layers of fabric and one of the cited adhesive materials, with the adhesive material preferably being used in the form of a film. Subsequently, the first and second layers of fabric and the adhesive-material film are superimposed in a certain order corresponding to the particular purpose of the penetration-resistant material. For soft-ballistics purposes, for example, layers are formed and pressed together in the following order: adhesive-material film/first layer of fabric/adhesive-material film/second layer of fabric/adhesive-material film. For hard-ballistics purposes, for example, layers are formed in the following order: adhesive-material film/first layer of fabric/adhesive-material film/second layer of fabric; then a certain number of the cited layers, depending on the intended ballistic-protective action, are superimposed and pressed together to form panels. In manufacturing the layers for soft-ballistics purposes, multiple super-imposed layers of the aforementioned type can also be concurrently pressed together, as long as it is ensured by suitable means, such as separating paper, that these layers are separable after having been pressed together. After pressing, a protective layer for the underlying layer of fabric is concurrently formed by the adhesive-material films facing outside during formation of the layers. A static press, for example, is suitable for the pressing procedure. Pressing is performed in the static press, preferably at a temperature from 80 to 220° C., a pressure of 5 to 100 bar, and for 15 to 150 seconds per layer. Then the heating of the press is switched off.

For determination of the layer thickness in a material wherein multiple layers were pressed together (hard ballistics), the total thickness is measured initially and the determined value is divided by the number of layers, giving the thickness D of one layer in the penetration-resistant material of the invention. Finally, the ratio D/F is determined using the initially defined equivalent filament diameter F.

The invention is further illustrated by the following examples.

EXAMPLE 1

Soft Ballistics

A penetration-resistant material a) (see row a) in Table 1) is produced as follows:

A fabric comprised of poly-paraphenylene terephthalamide warp threads (Twaron® by Teijn Twaron) having the linear density, thread count, and filament diameter F as in row a) of Table 1, and of polyester weft threads (trade name TREVIRA® by Hoechst) having a linear density of 140 dtex and a thread count of 2 threads/cm is used for the first layer of fabric.

A fabric comprised of poly-paraphenylene terephthalamide weft threads (Twaron® by Teijn Twaron) having the linear density, thread count, and filament diameter F as given in row a) of Table 1 and of polyester warp threads (TREVIRA® by Hoechst) having a linear density of 140 dtex and a thread count of 4 threads/cm is used for the second layer of fabric.

An LDPE film available as "LDPE Flachfolie, transparent, 10 $\mu$m" (EKB Kunststoffe) serves as the adhesive material.

23 layers (order in each layer: adhesive-material film/first layer of fabric/adhesive-material film/second layer of fabric/adhesive-material film), separated from each other by a paper, are superimposed and pressed in a press at a temperature of 120° C. and a pressure of 25 bar for 25 minutes. Then the heating of the press is switched off. Afterwards, the layers are separated from each other, the paper is removed, the 23 layers are superimposed again and packed together to form a package. The thickness of each layer of the resulting package (designated by a) in Table 1) is measured under a load of 0.1 N/cm$^2$ according to DIN EN ISO 5084. Finally, the ratio D/F (see row a) in Table 1) is determined using the initially defined filament diameter F. The weight per unit area of the package is also given in Table 1.

The antiballistic-protective action of package a) is characterized by determination of the $V_{50}$ value according to the technical guideline "Schutzwesten der deutschen Polizei" ("Protective vests for German police") with 9×19 caliber Para Type DM41 bullets (DAG). The results are summarized in row a) of Table 1.

Furthermore, materials b) and c) were produced the same way as material a) except that poly-paraphenylene terephthalamide weft threads were used having the linear density, thread count, and filament diameter values as given in Table 1 in rows b) and c), respectively.

TABLE 1

| Material | Weight per unit area [g/m$^2$] | Linear density [dtex] | Thread count [cm$^{-1}$] | $V_{50}$ [m/s] | D [mm] | F [mm] | D/F |
|---|---|---|---|---|---|---|---|
| a) | 5050 | 840 | 9.5 | 507 | 0.27 | 0.0087 | 31.0 |
| b) | 5060 | 930 | 9.5 | 483 | 0.28 | 0.0092 | 30.4 |
| c) | 5040 | 1680 | 5.5 | 462 | 0.35 | 0.012 | 29.2 |

Table 1 shows that materials with good $V_{50}$ values are obtained, although D/F is far above 12.8. Moreover, it can be seen that with increasing ratio D/F, the $V_{50}$ values increase even further, while the weight per unit area of materials a) to c) remains practically constant.

EXAMPLE 2

Hard Ballistics

A penetration-resistant material d) (see Table 2) is produced as follows:

A fabric comprised of poly-paraphenylene terephthalamide warp threads (Twaron® by Teijn Twaron) having the linear density, thread count, and filament diameter F as given in Table 2, and of polyester weft threads (TREVIRA® by Hoechst) having a linear density of 140 dtex and a thread count of 2 threads/cm, is used for the first layer of fabric.

A fabric comprised of poly-paraphenylene terephthalamide weft threads (Twaron® by Teijn Twaron) having the linear density, thread count, and filament diameter F as given in Table 2, and of polyester warp threads (TREVIRA® by Hoechst) having a linear density of 140 dtex and a thread count of 4 threads/cm, is used for the second layer of fabric.

A material available as LDPE no. 251-50 (Caplast Kunststoffverarbeitungs GmbH) serves as the adhesive material, which is applied to one side of each layer of fabric.

28 layers (order in each layer: adhesive-material coating/first layer of fabric/adhesive-material coating/second layer of fabric) are superimposed and pressed in a static press at a temperature of 120° C. and a pressure of 30 bar for 40 minutes. Then the heating of the press is switched off. The thickness of the resulting panel d) is measured under a load of 0.1 N/cm$^2$ according to DIN EN ISO 5084, and the measured value is divided by the number of layers to give the thickness D of one layer of panel d) (see Table 2). Finally, the ratio D/F is determined using the initially defined filament diameter F (see Table 2). The weight per unit area of panel d) is also given in Table 2.

The antiballistic-protective action of panel d) is characterized by determination of the $V_{50}$ value according EN 1063 class B3 with .357 caliber bullets of type Magnum VMKS "Vollmantel Kegel Spitz" (Geco) (by Dynamite Nobel). The results are summarized in Table 2.

TABLE 2

| Panel | Weight per unit area [g/m$^2$] | Linear density [dtex] | Thread count [cm$^{-1}$] | $V_{50}$ [m/s] | D [mm] | F [mm] | D/F |
|---|---|---|---|---|---|---|---|
| d) | 6900 | 930 | 9.5 | 496 | 0.19 | 0.0092 | 20.6 |

Table 2 shows that a material with a good $V_{50}$ value is obtained, although D/F is far above 12.8.

What is claimed is:

1. Penetration-resistant material comprising at least one layer having a thickness D, the layer comprising a first and second layer of woven fabric, with the first and second layers being bonded together with an adhesive material, the first layer of fabric composed of a first set of threads comprising 3.5 to 20 threads/cm, having a linear density of at least 210 dtex, the filaments forming the threads having a diameter $F_1$, and comprising at least 65% of the first layer fabric weight, and a second set of threads comprising 0.5 to 16 threads/cm and having a linear density of at least 50 dtex, with the second set of threads being at an angle of>0° to 90° with respect to the first set of threads, and the ratio of the number of threads/cm of the first set to that of the second set being greater than 1:1, and the second layer of fabric being composed of a first set of threads comprising 0.5 to 16 threads/cm and having a linear density of at least 50 dtex, and a second set of threads comprising 3.5 to 20 threads/cm, having a linear density of at least 210 dtex, and comprising at least 65% of the second layer fabric weight, the filaments forming the threads having a diameter $F_2$, with the second set of threads being at an angle of>0° to 90° with respect to the first set of threads, and the ratio of the number of threads/cm of the second set to that of the first set being greater than 1:1, and the first and second sets of threads of the first fabric layer being oriented parallel to the first and second sets of threads, respectively, of the second fabric layer and the ratio $D/F_1$ and $D/F_2$ being 14.5 to 40.

2. Penetration-resistant material according to claim 1, wherein $D/F_1$ and $D/F_2$ are 16 to 36.

3. Penetration-resistant material according to claim 1, wherein $D/F_1=D/F_2$.

4. Penetration-resistant material according to claim 1, wherein the ratio of the linear density of the first set of threads to the linear density of the second set of threads of the first layer of fabric and of the linear density of the second set of threads to the linear density of the first set of threads of the second layer of fabric is greater than 1:1.

5. Penetration-resistant material according to claim 1, wherein the ratio of the linear density of the first set of threads to the linear density of the second set of threads of the first layer of fabric and of the linear density of the second set of threads to the linear density of the first set of threads of the second layer of fabric is greater than 4.2:1.

6. Penetration-resistant material according to claim 1, wherein the ratio of the linear density of the first set of threads to the linear density of the second set of threads of the first layer of fabric and of the linear density of the second set of threads to the linear density of the first set of threads of the second layer of fabric is greater than 5.9:1.

7. Penetration-resistant material according to claim 1, wherein at least one of the second sets of threads of the first layer of fabric and the first sets of threads of the second layer of fabric comprises 0.5 to 8 threads/cm.

8. Penetration-resistant material according to claim 1, wherein the adhesive material is selected from one of the groups of thermoplastic, elastomeric, or thermoset materials, or a mixture of at least two of these groups.

9. Penetration-resistant material according to claim 1, wherein the first set of threads of the first layer of fabric and the second set of threads of the second layer of fabric consist of high tenacity yams selected from one of the groups of aramids, polyethylenes or poly-p-phenylenebenzobisoxazoles.

10. Penetration-resistant material according to claim 1, wherein the second set of threads of the first layer of fabric and the first set of threads of the second layer of fabric are selected from yarns from one of the groups of polyesters, polyethylenes, or aramids.

11. Penetration-resistant material according to claim 1, wherein the first set of threads of the first layer of fabric and the second set of threads of the second layer of fabric consist of aramid threads, and the second set of threads of the first layer of fabric and the first set of threads of the second layer of fabric consist of polyester threads.

12. Penetration-resistant material according to claim 1, wherein the linear density of the first set of threads of the first layer of fabric and the second set of threads of the second layer of fabric is 210 to 3720 dtex.

13. Penetration-resistant material according to claim 1, wherein the linear density of the second set of threads of the first layer of fabric and the first set of threads of the second layer of fabric is 50 to 280 dtex.

14. Penetration-resistant material according to claim 1, wherein the first set of threads of the first layer of fabric and the first set of threads of the second layer of fabric are warp threads and the second set of threads of the first layer of fabric and the second set of threads of the second layer of fabric are weft threads.

15. Penetration-resistant material according to claim 1, wherein at least one of the outer sides of the material is provided with a protective layer.

* * * * *